US008047329B1

(12) United States Patent
Douglas et al.

(10) Patent No.: US 8,047,329 B1
(45) Date of Patent: Nov. 1, 2011

(54) SYSTEM AND METHOD FOR NOISE SUPPRESSION

(75) Inventors: Alan Richard Douglas, Chula Vista, CA (US); Ray Listak, Chula Vista, CA (US)

(73) Assignee: Rohr, Inc., Chula Vista, CA (US)

( * ) Notice: Subject to any disclaimer, the term of this patent is extended or adjusted under 35 U.S.C. 154(b) by 0 days.

(21) Appl. No.: 12/856,377

(22) Filed: Aug. 13, 2010

(51) Int. Cl.
*E04B 1/84* (2006.01)

(52) U.S. Cl. ..... 181/292

(58) Field of Classification Search ..... 181/292, 181/210, 293
See application file for complete search history.

(56) References Cited

U.S. PATENT DOCUMENTS

| | | | | |
|---|---|---|---|---|
| 3,952,831 | A * | 4/1976 | Bernard et al. | 181/292 |
| 5,785,919 | A * | 7/1998 | Wilson | 264/401 |
| 6,114,652 | A * | 9/2000 | Clarke et al. | 219/121.71 |
| 6,274,216 | B1 * | 8/2001 | Gonidec et al. | 428/116 |
| 6,371,242 | B1 * | 4/2002 | Wilson et al. | 181/292 |
| 6,536,556 | B2 * | 3/2003 | Porte et al. | 181/292 |
| 7,434,659 | B2 * | 10/2008 | Ayle | 181/292 |
| 2005/0178489 | A1 * | 8/2005 | Belleguic et al. | 156/64 |
| 2008/0020176 | A1 * | 1/2008 | Ayle | 428/118 |

* cited by examiner

*Primary Examiner* — Jeremy Luks
(74) *Attorney, Agent, or Firm* — Knobbe Martens Olson & Bear LLP

(57) ABSTRACT

Systems and methods for noise suppression are disclosed herein. In one embodiment, an acoustic structure has a core that includes a plurality of cells. Each of the plurality of cells includes one or more engaging structures for positioning a septum relative to the cell. The acoustic structure further includes a plurality of septums positioned relative to the plurality of cells.

26 Claims, 16 Drawing Sheets

SYSTEM AND METHOD FOR NOISE SUPPRESSION

BACKGROUND

1. Field

This application generally relates to structural noise suppression systems.

2. Description of the Related Technology

Since the earliest days of commercial jet aircraft, great efforts have been expended in developing methods and structures for reducing engine noise. Many different sound absorbing linings have been applied to intake bypass ducts, compressor casings, and other components in aircraft turbine engines and turbine engine nacelles.

SUMMARY

The systems, methods, and apparatuses of the invention each have several aspects, no single one of which is solely responsible for its desirable attributes. Without limiting the scope of this invention as expressed by the claims which follow, its more prominent features will now be discussed briefly. After considering this discussion, and particularly after reading the section entitled "DETAILED DESCRIPTION OF THE PREFERRED EMBODIMENTS" one of ordinary skill in the art will appreciate how the features of this invention provide for noise suppression.

One aspect is an acoustic structure that includes a core. The core comprises a plurality of cells. Each of the plurality of cells comprises one or more engaging structures for positioning a septum relative to the cell. The acoustic structure further comprises a plurality of septums positioned relative to the plurality of cells.

Another aspect includes a method of reducing noise. The method includes installing an acoustic structure proximal to a source of noise. The acoustic structure comprises a core comprising a plurality of cells. Each of the plurality of cells comprises one or more engaging structures for positioning a septum relative to the cell. The acoustic structure further comprises a plurality of septums disposed relative to the plurality of cells.

Another aspect is a method of manufacturing an acoustic structure. The method comprises providing a core comprising a plurality of cells. At least one of the plurality of cells comprises at least one engaging structure for positioning a septum relative to the cell. The method further comprises inserting a septum having at least one engaging structure into the at least one of the plurality of cells. The engaging structure of the septum abuts the engaging structure of the cell so as to hinder movement of the septum relative to the cell in at least one direction.

Another aspect is a core comprising at least one cell having an inner surface and at least one septum. At least a portion of the septum engages the inner surface so as to hinder movement of the septum relative to the cell.

Another aspect is an acoustic structure that includes a perforated first sheet, an imperforate second sheet, and a core structure. The core structure includes a plurality of cells defined by cell walls disposed between the first and second sheets. The cells walls define an interior perimeter surface for each cell. The acoustic structure further includes a septum disposed within each of the cells. Each septum has an outer perimeter surface adjacent to the interior perimeter surface of the cell it is disposed within. Each cell includes at least one opening and a portion of the septum disposed within the cell extends through the opening.

Another aspect includes a method of manufacturing an acoustic structure, the method comprising providing a core comprising a plurality of cells, wherein each of the plurality of cells comprises one or more engaging structures for positioning a septum relative to the cell, inserting a plurality of septums into the plurality of cells, and sealing the septums within the cells.

Figure 1:
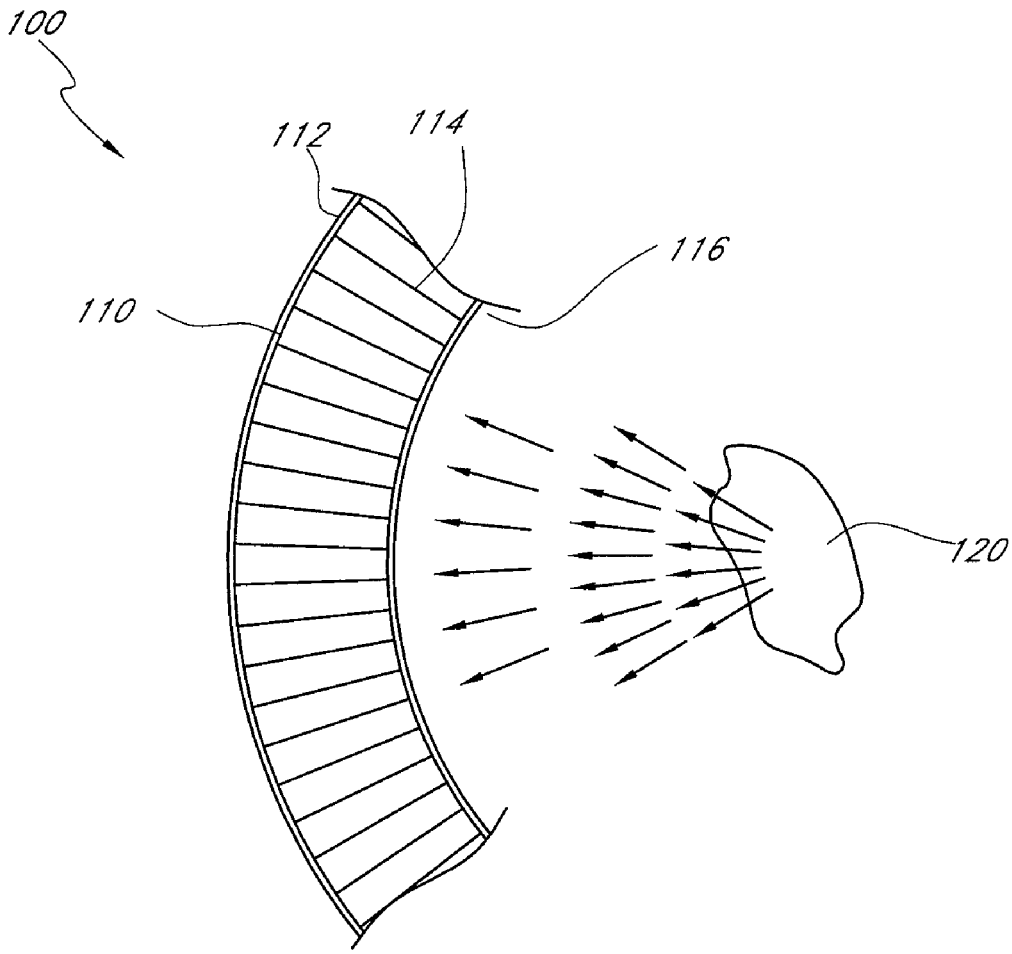
FIG. 1 is a partial sectional view of an acoustic structure located near a noise source.

The various features illustrated in the drawings may not be drawn to scale. Accordingly, the dimensions of the various features may be arbitrarily expanded or reduced for clarity. In addition, some of the drawings may be simplified for clarity. Thus, the drawings may not depict all of the components of a given apparatus, device, system, method, or any other illustrated component or process. Like reference numerals may be used to denote like features throughout the specification and figures.

DETAILED DESCRIPTION OF THE PREFERRED EMBODIMENTS

Various aspects of methods, systems, and apparatuses are described more fully hereinafter with reference to the accompanying drawings. These methods, systems, and apparatuses may, however, be embodied in many different forms and should not be construed as limited to any specific structure or function presented throughout this disclosure. Rather, these aspects are provided so that this disclosure will be thorough and complete, and will fully convey the scope of these methods, systems, and apparatuses to those skilled in the art. Based on the descriptions herein, one skilled in the art should appreciate that the scope of the disclosure is intended to cover any aspect of the methods, systems, and apparatuses disclosed herein, whether implemented independently of or combined with any other aspect of the disclosure. For example, a system or apparatus may be implemented or a method may be practiced using any number of the aspects set forth herein. In addition, the scope of the disclosure is intended to cover such an apparatus, system, or method which is practiced using other structure, functionality, or structure and functionality in addition to or other than the various aspects of the disclosure set forth herein. It should be understood that any aspect of the disclosure herein may be embodied by one or more elements of a claim.

The following description and the accompanying figures, which describe and show the preferred embodiments, are made to demonstrate several possible configurations that an acoustic structure can take to include various aspects and features of the invention.

FIG. 1 is a partial sectional view of a noise suppression system. The system 100 includes an acoustic structure 110 located proximal to a noise source 120. The acoustic structure 110 includes an outer layer 112, an inner layer 116, and a core 114 sandwiched therebetween. In one embodiment, the outer layer 112 is a solid layer whereas the inner layer 116 is a perforated layer. Each cell of the core 114 forms a hollow cavity which acts as a Helmholtz resonator to attenuate noise. Thus, noise generated by the noise source 120 enters the core 114 through the inner layer 116 and is attenuated.

The noise source 120 can be, for example, a jet engine and the acoustic structure 110 can be a portion of a nacelle around the engine or engine intake. Although the portion of the acoustic structure 110 illustrated is arranged in an arc to the left of the noise source 120, the acoustic structure 110 is not limited to the arc length. For example, the acoustic structure 110 may form a cylindrical shape which surrounds the noise source 120.

Figure 2:
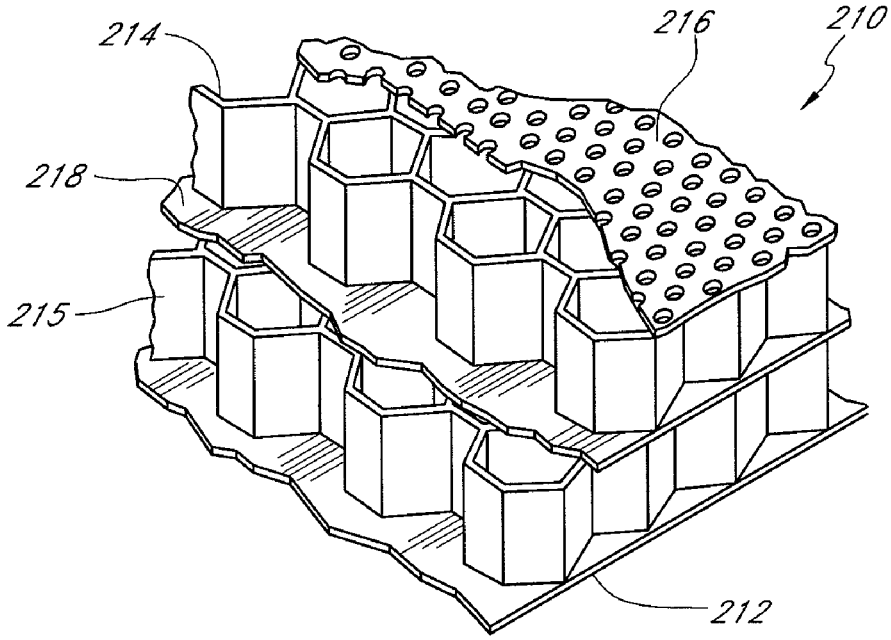
FIG. 2 is a perspective view, partially cutaway, of a dual degree of freedom (DDOF) acoustic structure.

The acoustic structure 110 of FIG. 1 is referred to as a single degree of freedom (SDOF) structure. FIG. 2 is a partially cutaway perspective view of a dual (or double) degree of freedom (DDOF) acoustic structure. Both structures 110 and 210 can reduce noise from a noise source.

The acoustic structure 210 of FIG. 2 includes an inner layer 216 and an outer layer 212. In one embodiment, the inner layer 216 is perforated and the outer layer 212 is solid. Between the inner layer 216 and the outer layer 212 is a middle layer 218. In one embodiment, the middle layer 218 is solid. In another embodiment, the middle layer 218 is porous or perforated. Between the inner layer 216 and the middle layer 218 is a first core 214. Between the middle layer 218 and the outer layer 212 is a second core 215. The cross-section of the first core 214 and second core 215 can have many shapes. Further, the layers can have different shapes. In one embodiment, the first core 214 and the second core 215 both have a honeycomb structure. In one embodiment, the cross-section of the first core 214 and second core 215 comprises tessellated hexagons. In one embodiment, including the illustrated embodiment of FIG. 2, the hexagons are regular hexagons. In other embodiments, the hexagons are irregular.

In one embodiment, including the illustrated embodiment of FIG. 2, the first core 214 and second core 215 are co-axially aligned. Thus, the cross-section of the first core 214 and the cross-section of the second core 215 are aligned in the axial direction. In another embodiment, the first core 214 and second core 215 are offset from each other. Alternatively, only a portion of each core is offset from a portion of the other core.

Figure 3:
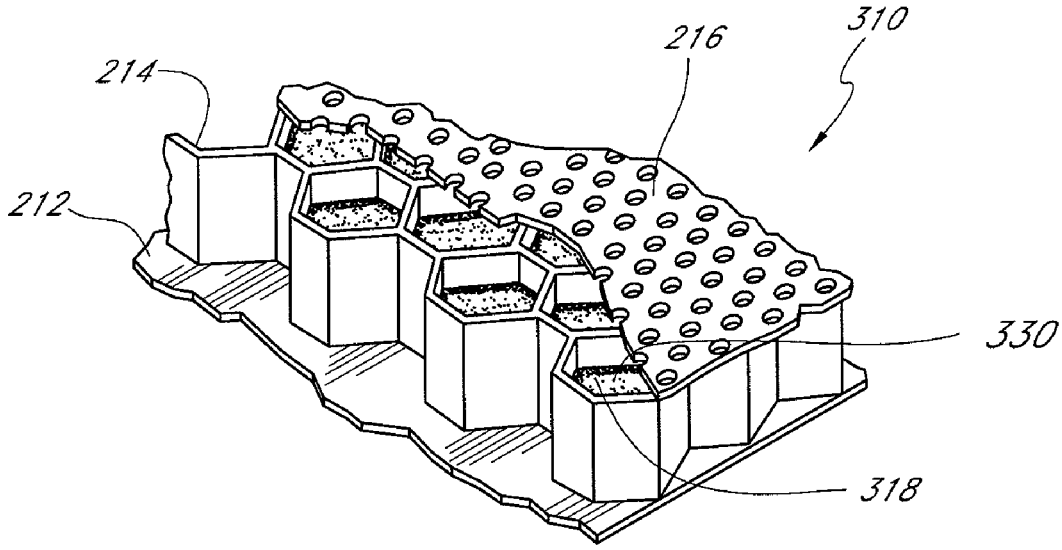
FIG. 3 is a perspective view, partially cutaway, of a single degree of freedom (SDOF) acoustic structure.

FIG. 3 is a perspective view, partially cut away, of a single degree of freedom (SDOF) acoustic structure 310. Whereas the DDOF structure 210 of FIG. 2 included two cores 214, 215 separated by a middle layer 218, the DDOF structure 310 of FIG. 3 includes a single core 214. Each cell of the core is separated into two cells by a septum 330 disposed between the ends of the cell. The acoustic structure 310 can be used as the acoustic structure 110 of FIG. 1 to reduce noise from a noise source.

The acoustic structure 310 of FIG. 3 includes an inner layer 216, an outer layer 212, and a core 214 sandwiched therebetween. In some embodiments, the inner layer 216 is perforated and the outer layer 212 is solid or imperforate. Each cell of the core 214 is separated by a septum 330 into an inner cell nearer the inner layer 216 and an outer cell nearer the outer layer 212. Each septum 330 is, in one embodiment, held in place by an adhesive 318. The adhesive 318 can also be a sealant, which substantially seals the inner cell apart from the outer cell around the periphery of the septum 330.

The outer layer 212 can be formed from any suitable material including metals such as titanium or aluminum, plastics such as phenolics, and composites such as fiber reinforced composites. The inner layer 216 may be formed of similar materials. In one embodiment, the inner layer 216 and outer layer 212 are formed of the same material. In another embodiment, the inner layer 216 and outer layer 212 are formed of different materials.

In one embodiment, the outer layer 212 is impervious to airflow and the inner layer 216 is perforated. The size, number, and spacing of perforations will depend on the acoustic requirements. In one embodiment, the perforations are between about 0.030 inches and 0.100 inches in diameter. In one embodiment, the perforations provide about 15% to 35% open area. In one embodiment, the perforations are arranged in a uniform pattern across the layer 216.

The core 214 can be formed form any suitable material including for example, metals such as titanium, aluminum, and alloys thereof, ceramics, and composite materials. In one embodiment, the core 214 is a honeycomb structure. In one embodiment, the cross-section of the core 214 comprises tessellated hexagons. In one embodiment, including the illustrated embodiment of FIG. 3, the hexagons are regular hexagons. In other embodiments, the hexagons are irregular. Of course the cross-section of the core 214 can comprise other shapes including parallelograms, rectangles, or squares. For example, the cross-section of the core 214 can comprise triangles. The cross-section of the core 214 can include more than one different shape, such as a triangle and a square.

Each septum 330 can be formed of any suitable material. Such materials are typically provided as relatively thin sheets that are perforated, porous, or an open mesh fabric that is designed to provide noise attenuation. The septum 330 can be formed of a perforated or porous sheet of metal, ceramic, or thermoplastic. In one embodiment, the septum 330 is formed of an open mesh fabric that is woven from monofilament fibers. The fibers can be composed of glass, carbon, ceramic, or polymers. Monofilament polymer fibers made from polyamide, polyester, polyethylene chlorotrifluoroethylene (ECTFE), ethylene tetrafluoroethylene (ETFE), polytetrafluoroethylene (PTFE), polyphenylene sulfide (PPS), polyfluoroethylene propylene (FEP), polyether ether ketone (PEEK), polyamide 9 (Nylon, 9 PA6), and polyamide 12 (Nylon 12, PA12) are just a few examples. Open mesh fabric made from PEEK can be particularly suitable in particular applications, such as, for example, high temperature applications.

As mentioned above, the septum 330 can be formed from a woven cloth. Suitable materials for a woven cloth include stainless steel, aluminum, titanium, and mixtures thereof. The woven cloth can also be made of non-metallic materials, as described above. A stainless steel woven material is strong, light weight, and has desirable sound attenuation characteristics. The strand crossover points may be joined by any conventional method, such as sintering or diffusion bonding.

As mentioned above, the septum 330 can be bonded to the core 214 with an adhesive 318. Exemplary adhesives include low solvent solution sprayable adhesive, adhesive films, epoxies, acrylics, phenolics, cyanoacrylates, bismaleimides, polyamineimides, and polyimides. During manufacture, placement and positioning of the septums 330 at the correct depth in the cells of the core 2 14 before the adhesive 318 is applied is important.

Figure 4:
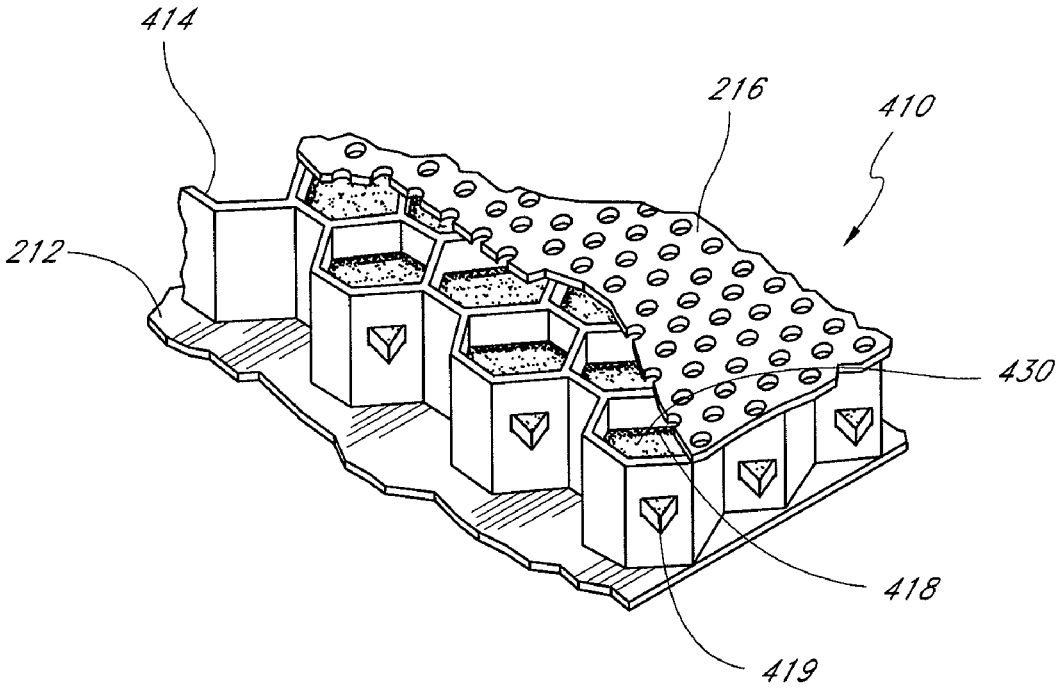
FIG. 4 is a perspective view, partially cutaway, of a single degree of freedom (SDOF) acoustic structure according to a preferred embodiment of the present invention and which includes engaging structure between a core and a plurality of septums.

FIG. 4 is a perspective view, partially cutaway, of a single degree of freedom (SDOF) acoustic structure with engaging structure. The acoustic structure 410 can be used to reduce noise in the same manner as the acoustic structure 110 of FIG. 1.

Like the acoustic structure 310 of FIG. 3, the acoustic structure of FIG. 4 includes an inner layer 216, an outer layer 212, and a core 414 sandwiched therebetween. In one embodiment, the inner layer 216 is perforated and the outer layer 212 is solid. Each cell of the core 414 is separated by a septum 430 into an inner cell nearer the inner layer and an outer cell nearer the outer layer. The outer perimeter of the each septum 430 is, in one embodiment, adhered to the inner wall of its respective cell by an adhesive 418. The adhesive 418 can also be a sealant, which substantially seals the inner cell apart from the outer cell, except via the septum.

The acoustic structure 410 of FIG. 4 differs from the acoustic structure 310 of FIG. 3 in that each of the core 414 and septums 430 include engaging structure which positions the septums with respect to the core 414 as is described in detail below. In particular, the core 414 is similar to the core 214 of FIG. 3 and the septums 430 are similar to the septums 330 of FIG. 3, except that the core 414 and septums 430 each include engaging structure. Various types of engaging structure are described below.

Figure 5A:
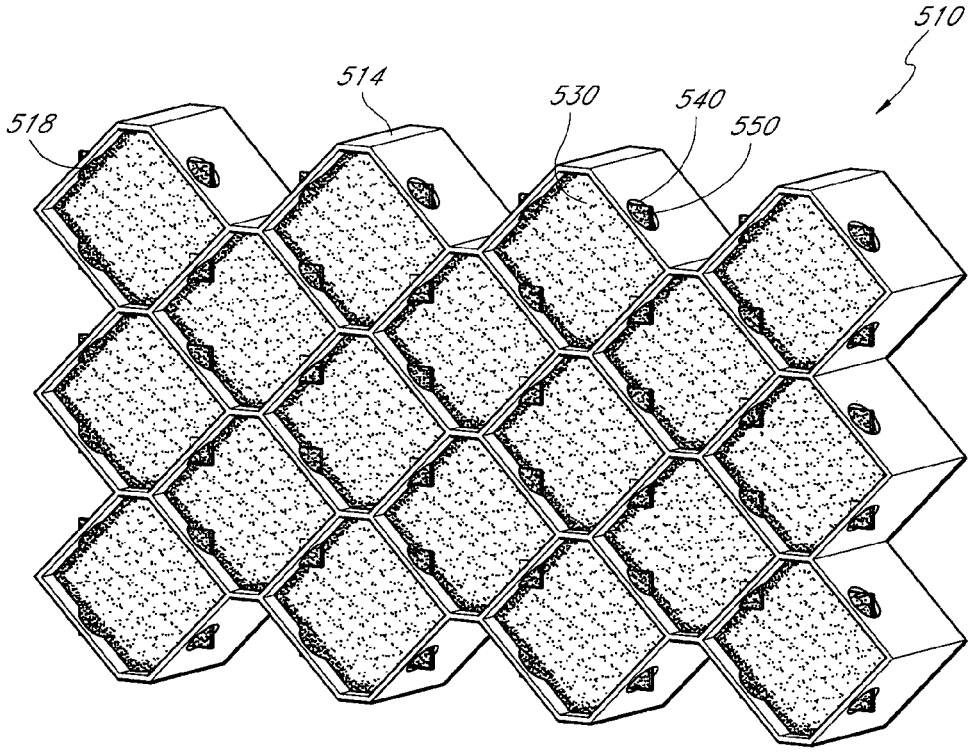
FIG. 5A is a perspective view of a portion of an acoustic structure according to another preferred embodiment of the present invention and which includes a core and septums with engaging structure.

FIG. 5A is a perspective view of a portion of an acoustic structure 510 having a core 514 and septums 530. The core 514 has engaging structure 540. The septums have corresponding engaging structure 550. The portion of the acoustic structure 510 can be attached to an inner layer 216 and outer layer 212 to form an acoustic structure for reducing noise as described above with respect to FIG. 1. The core 514 can be formed of similar materials as the core 214 of FIG. 3. Similarly, the septums 530 can be formed of similar materials as the septums 330 of FIG. 3.

Figure 13:
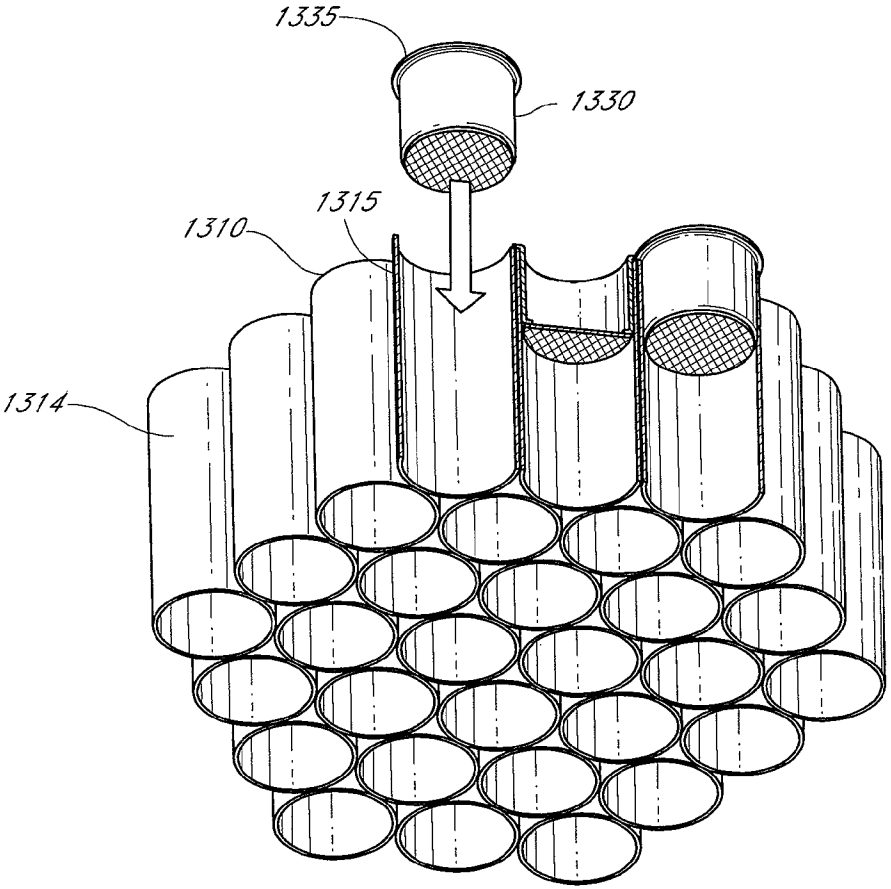
FIG. 13 is a perspective view, partially cutaway, of a single degree of freedom (SDOF) acoustic structure with engaging structure disposed at the edge of the core.

The core 514 includes a plurality of cells. The shape of the cells is not limited to the illustrated shapes and instead can have any shape. For example, the cells can have a shape of a six-sided polygon or hexagon as is illustrated in FIG. 5A. Other polygon shapes including, for example, triangle, quadrilateral, pentagon, heptagon, and octagon also fall within the scope of the disclosure. Further, the polygon shape may or may not be equilateral, regular, or equiangular. In some embodiments, at least a portion of the cell has an arc shape. For example, the cells can have a generally circular shape as is illustrated in FIG. 13, one or more circular segments, or other curved shape. The cells of the core 514 illustrated in FIG. 5A have a generally hexagonal cross-section. However, the cross-section is not a regular hexagon, but rather a hexagon with four long sides and two short sides, the two short sides being opposite each other.

Each cell includes engaging structure for contacting or receiving at least a portion of the septums 530. The engaging structure of the cells can include one or more holes 540, openings, slots, slits, notches, recesses, indentations, receptacles, grooves, protrusions, or other structure. The engaging structure may or may not have a bottom surface. Thus, in some embodiments the engaging structure may or may not penetrate entirely through the walls of the core 514.

The engaging structure illustrated in FIG. 5A is in the form of one or more holes 540 which penetrate through the walls of the core 514. The holes 540 receive the engaging structure of the septums 530. The shape of the engaging structure can be circular, rectangular (such as slots), triangular (as shown below with respect to FIGS. 16A-16C), or any other shape.

The engaging structure of the septums can be one or more tabs, protuberances, prongs, protrusions, or other structure for contacting the engaging structure of the cell. Further, the engaging structure may be a perimeter portion of the septum. The perimeter portion need not protrude from an adjacent perimeter portion of the septum. For example, the perimeter portion of the septum may contact a protruding engaging structure of the cell. The engaging structure of the septums 530 illustrated in FIG. 5A is in the form of tabs 550. With respect to the cells, each of the long sides of the cell includes an engaging structure in the form of a hole 540 for receiving the tab 550 of the septum 530.

The septum 530 has a shape substantially similar to that of the cross-section of the cell of the core 514 except that it includes one or more tabs 550 for engaging with the holes 540 of the core. The tabs 550 of the septum 530 protrude through the holes 540 of the core 514, thereby supporting and positioning the septum 530 within the cell of the core 514. Each septum 530 can be further secured and/or sealed with an adhesive 518 applied around the edges of the cell. Exemplary adhesives include low solvent solution sprayable adhesive, adhesive films, epoxies, acrylics, phenolics, cyanoacrylates, bismaleimides, polyamine-imides, and polyimides.

Figure 5B:
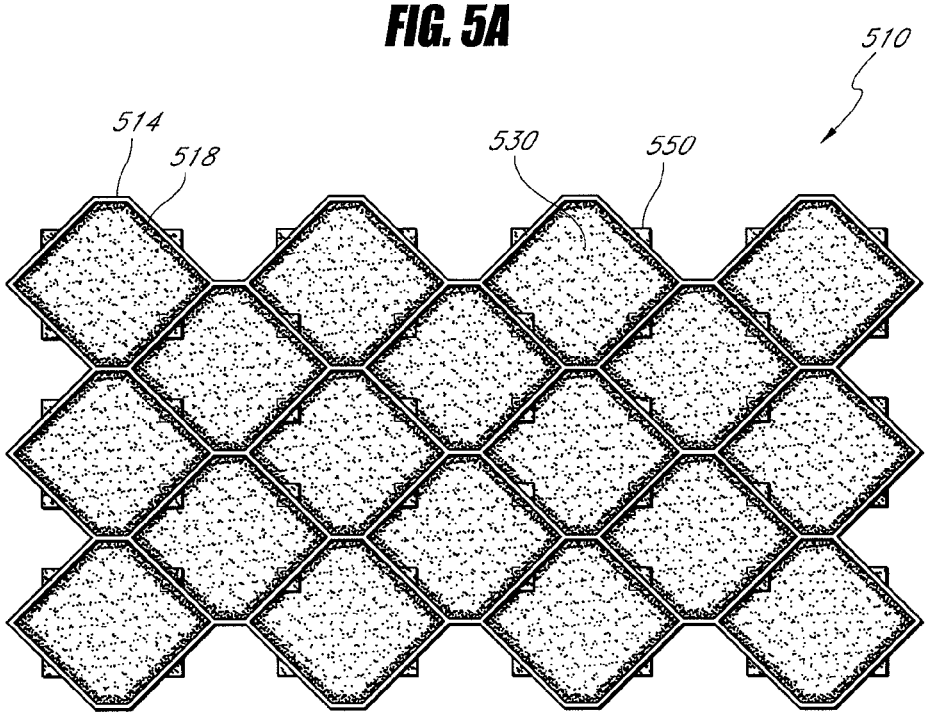
FIG. 5B is a top view of the portion of the acoustic structure of FIG. 5A.

FIG. 5B is a top view of the portion of the acoustic structure of FIG. 5A. As can be seen more clearly in the top view of FIG. 5B, the tabs 550 of a particular septum 530 protrude through the wall of the cell into an adjacent cell. Of course the tabs 550 need only protrude partially into the wall of the cell to engage with the cell. Thus, the tabs 550 need not protrude through the entire wall of the cell or into the adjacent cell to engage with the cell. Of course increasing the degree of engagement between the tab 550 and the wall of the cell may further hinder or prevent relative movement of the septum relative to the cell. Further, when a number of septums 530 are inserted into the core, the tabs 550 of a particular septum 530 can overlap with the tabs and the body of another septum 530 to further enhance the engagement between the septums 530 and the core 514.

Figure 5C:
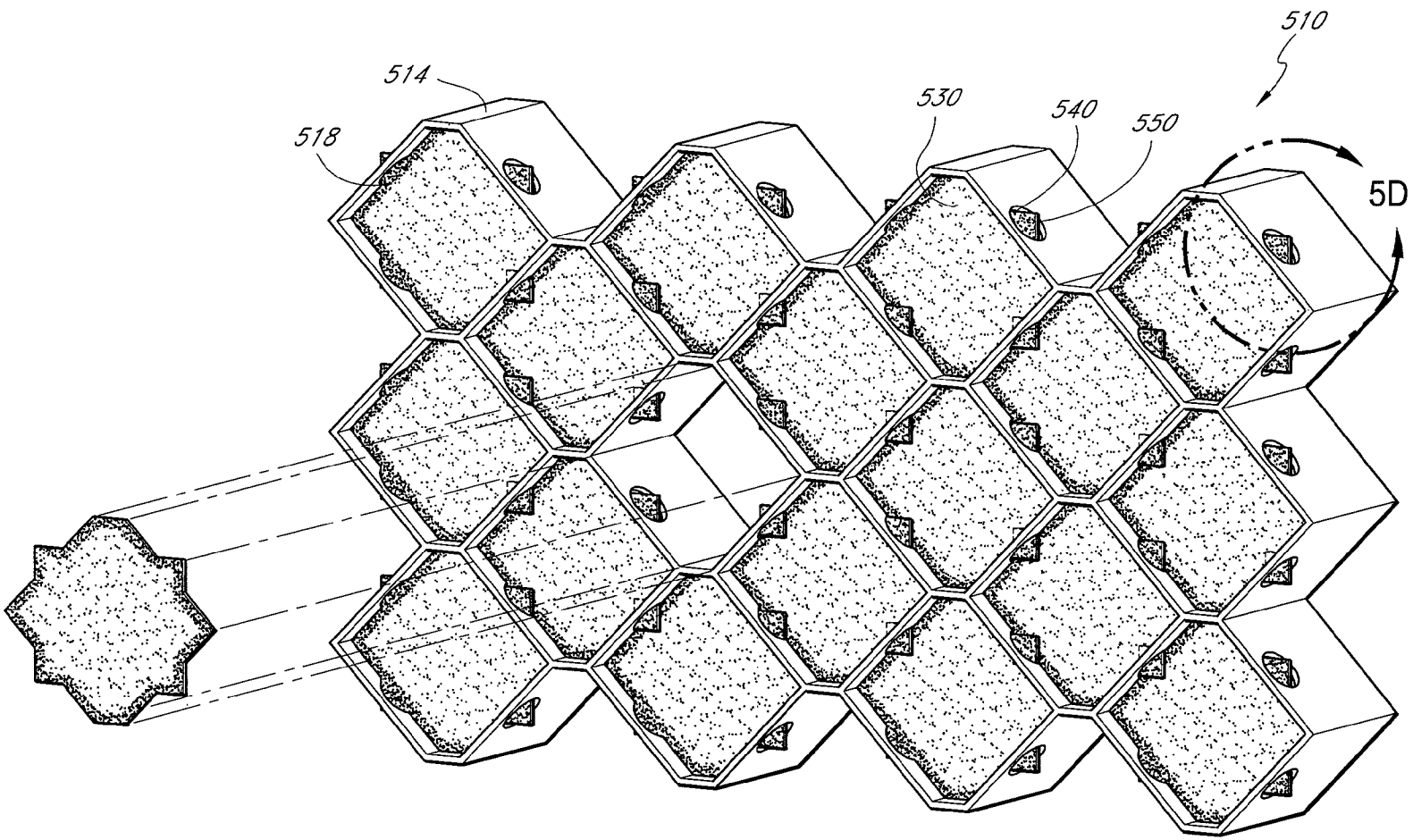
FIG. 5C is a perspective view, partially exploded, of the acoustic structure of FIG. 5A with a single septum separated from the core.

FIG. 5C is a perspective view, partially exploded, of the portion of the acoustic structure of FIG. 5A with a septum 530 separated from one cell. In particular, FIG. 5C illustrates the portion of the acoustic structure with one of the septums 530 removed from the core. As can be seen in FIG. 5C, the septum has a shape substantially similar to that of the cross-section of the cell of the core 514 except for the addition of one or more tabs 550 for engaging with the holes 540 of the core.

Figure 5D:
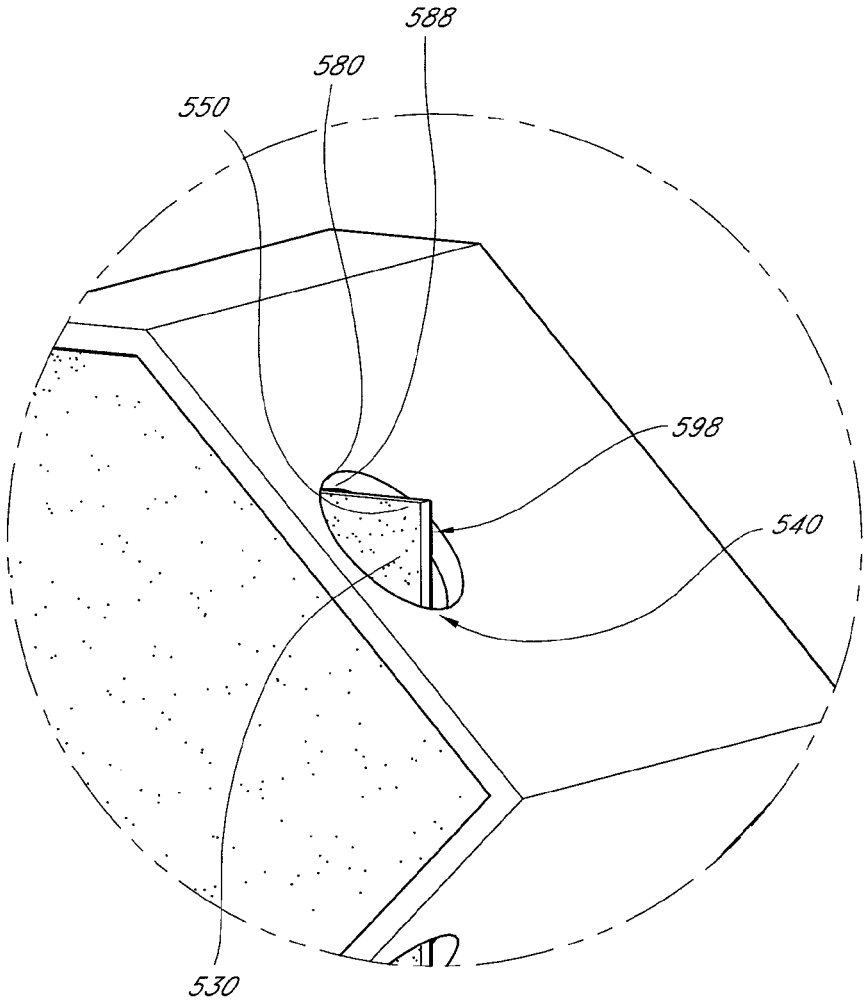
FIG. 5D is a close-up of the engaging structure of FIG. 5A.

FIG. 5D is a close-up of the engaging structures of the core 514 and septums 530 from FIG. 5A engaged with each other. In the embodiment described above, each cell of the core includes one or more holes 540 through which one or more tabs 550 of the septum 530 protrude. Each hole 540 is defined by an inner surface 580 of the core. The inner surface 580 need not be a smooth, continuous surface which extends around the entire inner circumference of the engaging structure. For example, the inner surface 580 can include a plurality of surfaces which together form a polygonal shape of the engaging structure in the wall of the cell.

Each inner surface 580 is angled with respect to the surface of the wall into which the engaging structure extends. For example as is illustrated in FIG. 5D, the inner surface 580 is substantially perpendicular to the wall of the cell.

At least a portion of the inner surface 580 defines one or more contact locations 588. The one or more contact locations 588 contact at least a portion of the engaging structure of the septums 530. The one or more contact locations 588 can be at one or more points, one or more lines, one or more areas, or any combination of points, lines and areas of the inner surface 580. For example, the contact locations 588 can be disposed on a lower portion 598 of the inner surface 580.

The number and type of contact locations 588 may vary between cells of the same core or vary for a single cell during assembly of a septum with a cell. In particular, the type of contact locations 588 with the septum 530 illustrated in FIG. 5D is a point contact. Specifically, the contact locations are at four points where the inner wall of the cell intersects with the inner surface 580. However, as explained above, the contact locations 588 are not limited to the illustrated arrangement and can include any combination of points, lines and areas.

With the septum 530 supported by the inner surface 580 of the hole 540, the septum 530 is hindered from sliding down into the cell without deforming at least a portion of the septum 530. Similarly, the septum 530 is hindered from sliding up and/or out of the cell.

Figure 6A:
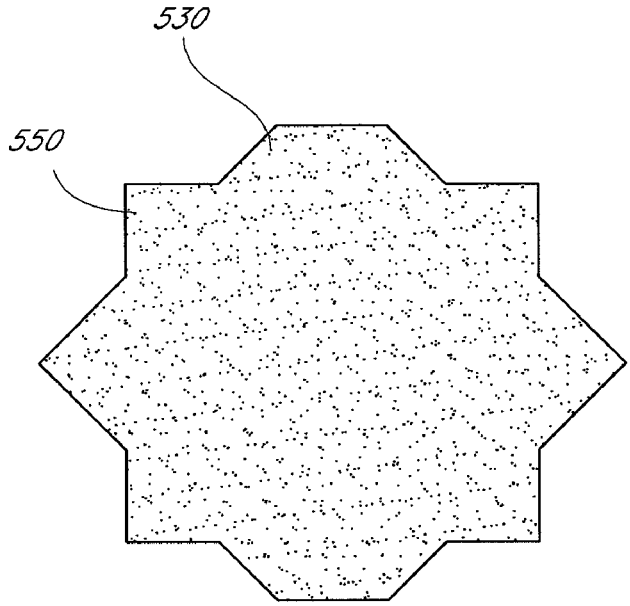
FIG. 6A is a top view of a septum according to a first embodiment.
Figure 6B:
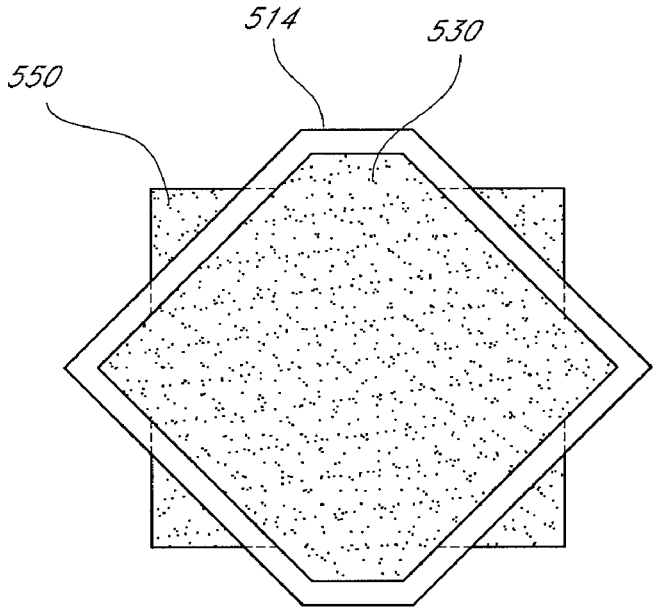
FIG. 6B is a top view of the septum of FIG. 6A inserted into a single cell of the core.

FIG. 6A is a top view of a septum according to a first embodiment. The septum 530 illustrated in FIG. 6A has a generally hexagonal shape with four tabs 550 arranged along the perimeter of the hexagon. FIG. 6B is a top view of a cell of the core with the septum 530 from FIG. 6A inserted therein. The septum 530 has a substantially similar shape to a cross-sectional shape of the cell of the core 514 with the four tabs 550 protruding through the walls of the cell.

Figure 7A:
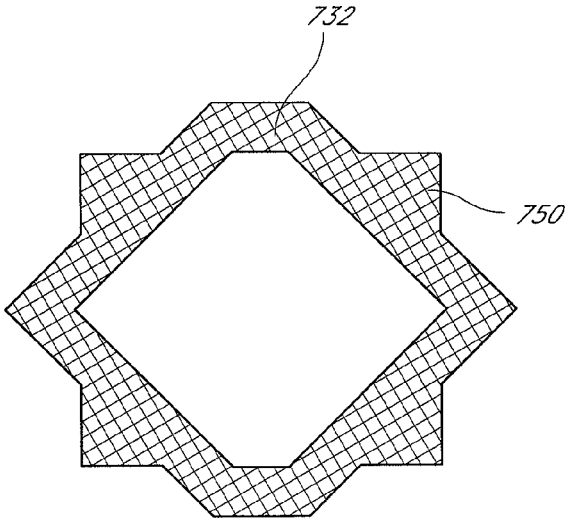
FIG. 7A is a top view of a support ring for use with a second embodiment of the septum.
Figure 7B:
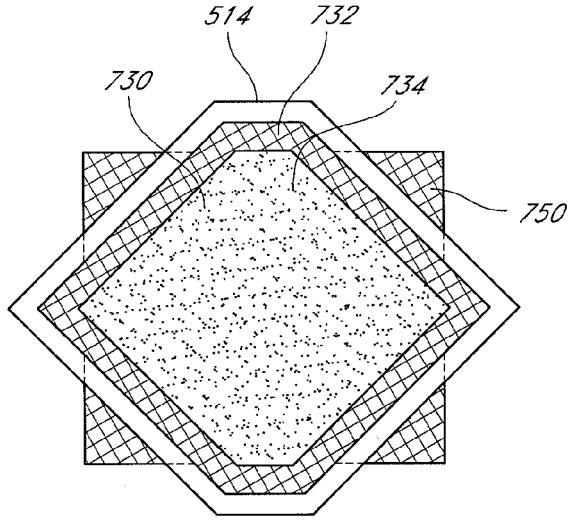
FIG. 7B is a top view of a septum according to the second embodiment, including the support ring of FIG. 7A disposed around the perimeter of the septum, inserted into a singe cell of the core.

FIG. 7A is a top view of a support ring 732 for use with a septum 730 according to a second embodiment. FIG. 7B is a top view of the septum 730, including the support ring 732 of FIG. 7A, inserted into a cell. The outer perimeter of the support ring 732 includes the engaging structure. Although the septums described above are made of a single structure, the septum 730 of FIG. 7B is made from two structures joined together. The two structures can also be made of different materials.

Within the cell of the core 514 is a hexagonal septum 730 having a support ring 732 surrounding a mesh layer 734. In one embodiment, the support ring 732 is made of plastic and the mesh layer 734 is made of a woven mesh material. The mesh layer 734 can be made of any material used to make the septum 330 of FIG. 3. The support ring 732 includes a plurality of tabs 750 which protrude through the engaging structures in the cell of the core 514 thereby positioning and supporting the septum 730 within the cell of the core 514.

Figure 8:
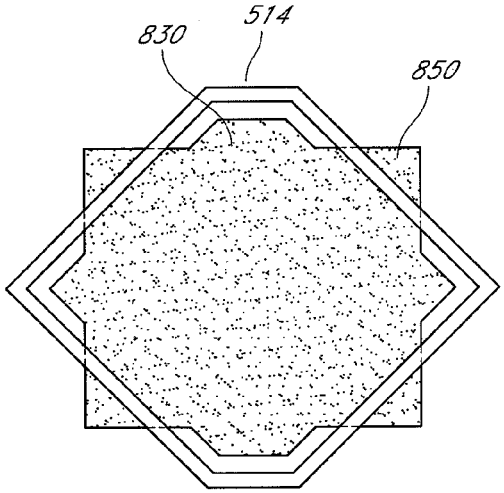
FIG. 8 is a top view of a septum inserted into a single cell of the core according to a third embodiment.

FIG. 8 is a top view of a septum 830 inserted into a cell according to a third embodiment. The septum 830 of FIG. 8 is similar to the septum 530 of FIGS. 6A-6B, except that the septum 830 of FIG. 8 has a smaller size and a different shape than the cross-sectional size and shape of the cell of the core 514, thus leaving a gap between the septum 830 and the core 514. Like the septum 530 of FIGS. 6A-6B, the septum 830 of FIG. 8 has four tabs 850 protruding through the walls of the cell of the core 514. The space or gap between the septum 830 and the core 514 may or may not be filled with an adhesive or other sealing structure such as a rubber seal.

Figure 9:
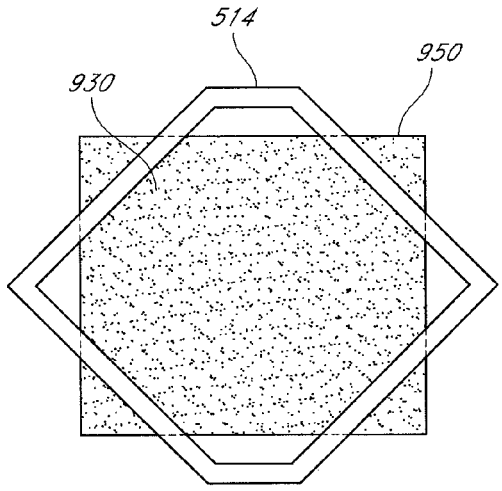
FIG. 9 is a top view of a septum inserted into a single cell of the core according to a fourth embodiment.

FIG. 9 is a top view of a septum 930 inserted into a cell according to a fourth embodiment. The septum 930 of FIG. 9 is also similar to the septum 530 of FIGS. 6A-6B, except that the septum 930 of FIG. 9 has a smaller size and different shape than the cross-sectional size and shape of the cell of core 514. In particular, the septum 930 has a different shape from that of the cross-sectional shape of the cell of the core 514. Like the septum 530 of FIGS. 6A-6B, the septum 930 of FIG. 9 has four tabs 950 protruding through the walls of the cell of the core 514. The space or gap between the septum 830 and the core 514 may or may not be filled with another structure such as adhesive.

Figure 10A:
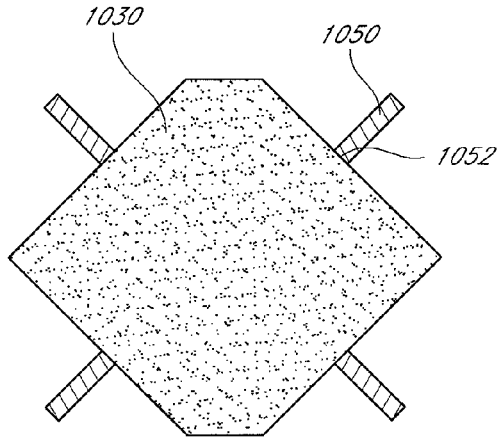
FIG. 10A is a top view of a septum according to a fifth embodiment.
Figure 10B:
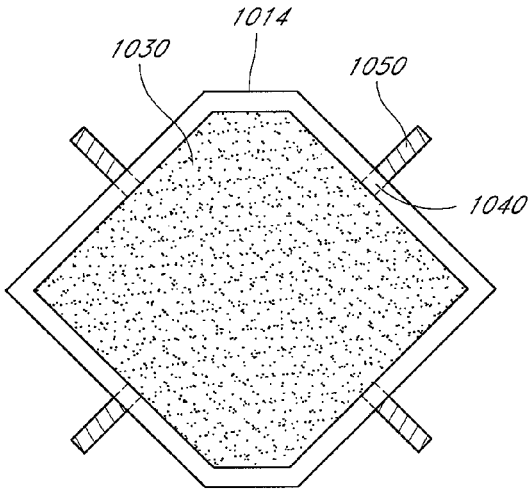
FIG. 10B is a top view of the septum of FIG. 10A inserted into a single cell of the core.

FIG. 10A is a top view of a septum 1030 according to a fifth embodiment. FIG. 10B is a top view of the septum of FIG. 10A inserted into a cell of a core 1014. The septum 1030 of FIGS. 10A-10B is similar to the septum 530 of FIGS. 5A-5D, except that different engaging structure is employed. For example, instead of tabs 550 protruding though the walls of the cell of the core 514 as in FIG. 5D, the septum 1030 of FIGS. 10A-10B includes one or more prongs 1050 for protruding through the walls of the cell of the core 1014. The core 1014 is similar to the core 514 of FIGS. 5A-5D and includes engaging structure in the form of holes 1040. The prongs 1050 of the septum 1030 protrude into and/or through the holes 1040 in the core 1014.

In one embodiment, the prongs 1050 are formed of a different material than the body of the septum 1030. The prongs 1050 can be attached to the body of the septum 1030 by welding or other attachment means 1052 known to those of skill in the art. In another embodiment, the prongs 1050 are formed integral to the body of the septum 1030.

In many of the embodiments described above, each cell of the core includes one or more inner surfaces defining engaging structure through which a portion of the engaging structure of the septum protrudes. As described above, the engaging structure of the cells is defined by an inner surface of the cell. However, the core may include other structure for supporting and/or positioning a septum within a cell of the core.

Figure 11A:
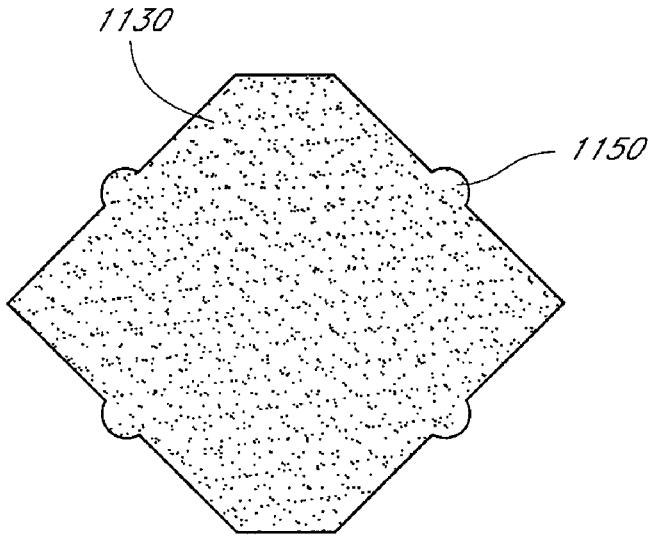
FIG. 11A is a top view of a septum according to a sixth embodiment.
Figure 11B:
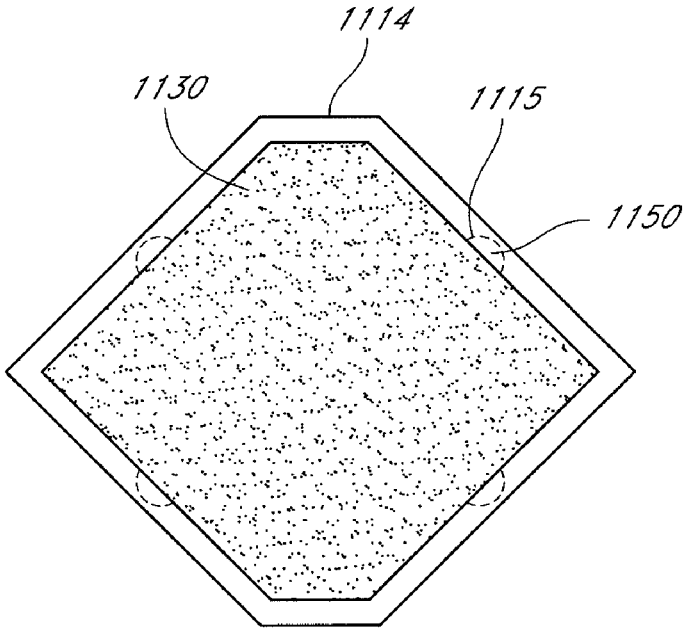
FIG. 11B is a top view of the septum of FIG. 11 inserted into a single cell of the core.

FIG. 11A is a top view of a septum 1130 according to a sixth embodiment. FIG. 11B is a top view of the septum 1130 of FIG. 11 inserted into a cell. The septum 1130 of FIGS. 11A-11B is similar to the septum 530 of FIGS. 6A-6B, except that instead of engaging structure in the form of tabs 550 protruding though the walls of the cell of the core 514, the septum 1130 of FIGS. 11A-11B includes one or more protuberances or protrusions 1150 which protrude into, but not through, the walls of the cell of the core 1114. The core 1114 is similar to the core 514 of FIGS. 6A-6B, except that rather than the engaging structure being in the form of holes 540 which define an opening through the walls of the core 514, the engaging structure of the core 1114 of FIG. 11B includes one or more recesses, indentations, receptacles, or grooves 1115 which may or may not penetrate entirely through the walls of the core 1114. In one embodiment, the engaging structure is a groove disposed in one or more sides of the cells. The groove may surround the entire cell to form a closed shape.

Although the indentations 1115 illustrated in FIG. 11B may not penetrate through the walls of the cell 1114, each indentation 1115 may be defined by an indentation surface including one or more contact surfaces which support the septum 1130.

In the embodiments described above, each cell of the core generally defines an axially aligned channel having a particular cross-sectional shape. In some embodiments, septums within the cell have a substantially similar shape, but include tabs, prongs, protrusions, or other engaging structures which extend beyond the channel into and perhaps through a wall of the cell. However, the core may include other structure for supporting and/or positioning a septum within a cell of the core which do not require corresponding engaging structures which protrude from the septum. For example, the engaging structure of the septum may be a perimeter portion of the septum which does not protrude from an adjacent perimeter portion of the septum.

Figure 12A:
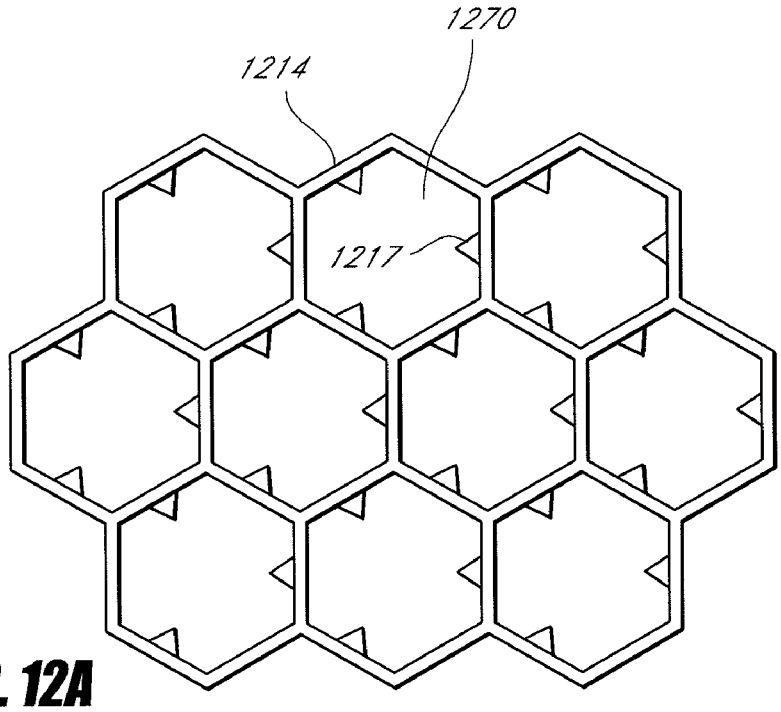
FIG. 12A is a top view of a core that has protrusions extending into each cell for engaging with the septums.
Figure 12B:
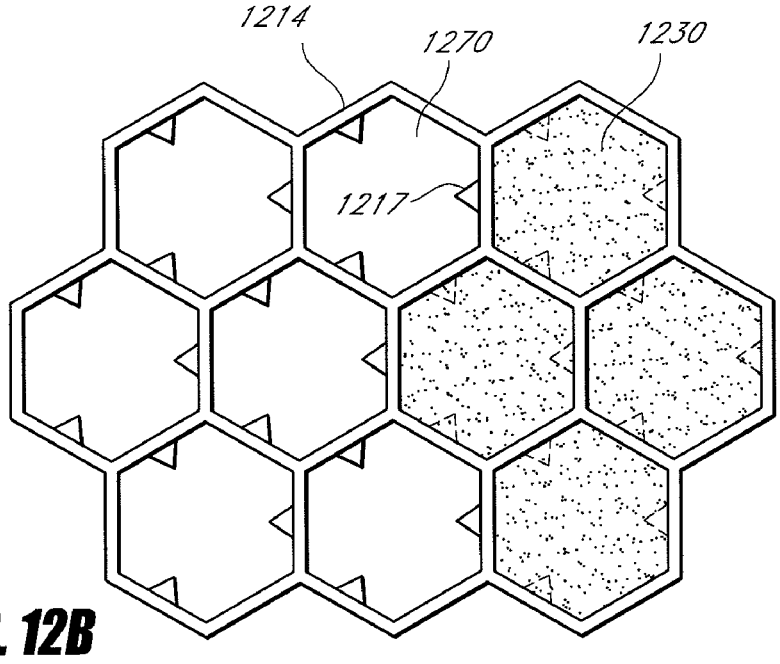
FIG. 12B is a top view of the core of FIG. 12A with four septums inserted into four cells of the core.

FIG. 12A is a top view of a core that has one or more protrusions 1217 extending into each cell. FIG. 12B is a top view of the core 1214 of FIG. 12A with four septums 1230 inserted into their respective cells. The core 1214 can be formed of the same materials as the core 214 of FIG. 3.

The core 1214 includes a number of cells defining channels 1270 with hexagonal cross-sections. Each cell includes at least one protrusion 1217 into the cell. In one embodiment, each cell includes three protrusions 1217 extending into the cell and three protrusions 1217 extending out of the cell (into an adjacent cell) arranged in an alternating fashion. In the case of a hexagonal septum, the first, third and fifth sides of the septum each includes a protrusion into the cell, while the second, fourth and sixth sides do not include a protrusion into the cell, but rather extending out of the cell into an adjacent cell. A septum 1230 having a similar shape to that of the cross-section of a channel 1270 is disposed within the cell and supported by one or more protrusions 1217. The septum 1230 can be formed of the same materials as the septum 330 of FIG. 3. The septum 1230 includes a perimeter portion which engages or contacts the protrusions 1217. However, the engaging structure of the septum 1230 is not a tab or protrusion, such as is described above. Indeed, the septum 1230 need not have tabs or protrusions which project beyond the channel 1270 of the core.

In some embodiments, such as those described above, each cell of the core includes engaging structure within channels of a core. In other embodiments, the engaging structure is located at an end of the axial channel.

FIG. 13 is a perspective view, partially cutaway, of a single degree of freedom (SDOF) acoustic structure with engaging structures disposed at the top of the core 1314. The core 1314 includes a plurality of circular cells 1315. The core 1314 can be formed of the same materials as the core 214 of FIG. 3. Within each cell 1315 is a cup-shaped septum 1330. The septum 1330 has a lip 1335 which engages with an edge 1310 on the top of the core 1314. For example, the lip 1335 of the septum 1330 can have a cross-section larger than the cross-section of the cell 1315. A lower surface of the lip 1335 engages with the edge 1310 of each cell 1315. Thus, the septum 1330 is positioned and supported within the cell 1315. The septum 1330 can be made of the same materials as the septum 330 of FIG. 3. In particular, the septum 1330 can be formed of more than one material.

Although FIG. 13 illustrates a cup-shaped septum 1330, other shapes can be used. For example, a cone-shaped septum including a lip with a lower surface or a dome-shaped septum including a lip with a lower surface can also be used. Further, although FIG. 13 illustrates physically separate septums, in one embodiment multiple septums are formed as a single piece generally joined at the lip portion 1335.

Figure 14A:
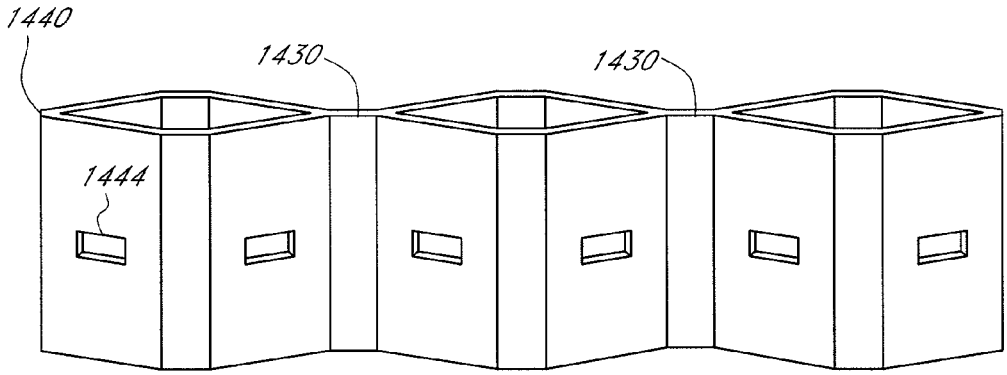
FIG. 14A is a perspective view of a row of cells which together form a portion of a core, the row of cells being formed from two core sheets.
Figure 14B:
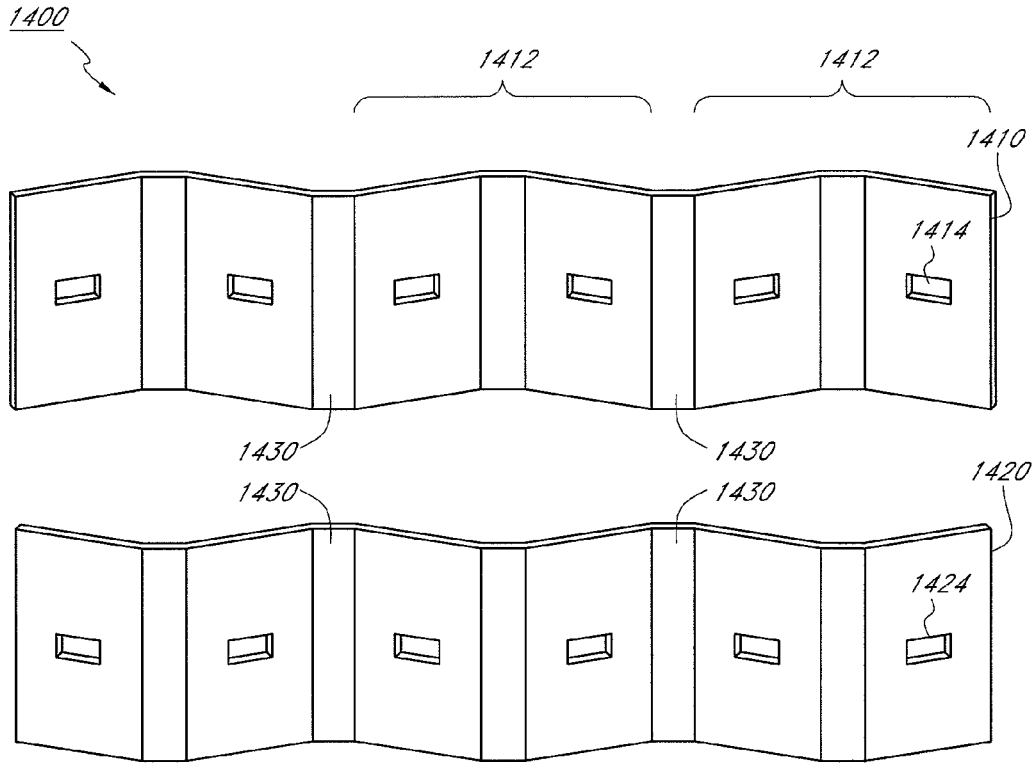
FIG. 14B is a perspective of the two core sheets from FIG. 14A prior to being joined to form the row of cells.

A core, such as the core 514 of FIGS. 5A-5D, can be formed from multiple core sheets 1410, 1420 joined together. FIG. 14A is a perspective view of a portion of core 1440 formed from joining two core sheets 1410, 1420 and including engaging structure 1444. FIG. 14B is a perspective of the components 1400 of the core 1440 of FIG. 14A separated into the core sheets 1410, 1420. A first core sheet 1410 can be formed by bending and perforating a strip of material into the shape illustrated in FIG. 14B. In particular, the strip of material is bent into a plurality of four panel sections 1412, wherein the second and fourth panels of each four-panel section are substantially parallel. Also, the first and third panels of each section are perforated, thereby imparting each perforated panel with an inner surface defining an opening 1414. A second core sheet 1420 can be formed in a similar fashion, by bending the strip of material into a plurality of four panel sections and perforating the first and third panels of each section, thereby imparting each perforated panel with an inner surface defining an engaging structure in the form of an opening 1424.

By offsetting the first core sheet 1410 with respect to the second core sheet 1420, the first core sheet 1410 and second core sheet 1420 can be aligned such that joining panels 1430 are located proximate to each other. The joining panels 1430 include the fourth panel of each section 1412 of the first core sheet 1410 and the second panel of each section of the second core sheet 1420.

The core sheets 1410, 1420 can be joined by attaching the joining panels 1430 together. The joining panels 1430 can be attached by, for example, welding or other known methods. Although FIG. 14A only shows a portion of core, an entire core can be formed from such core sheets joined together.

Figure 15:
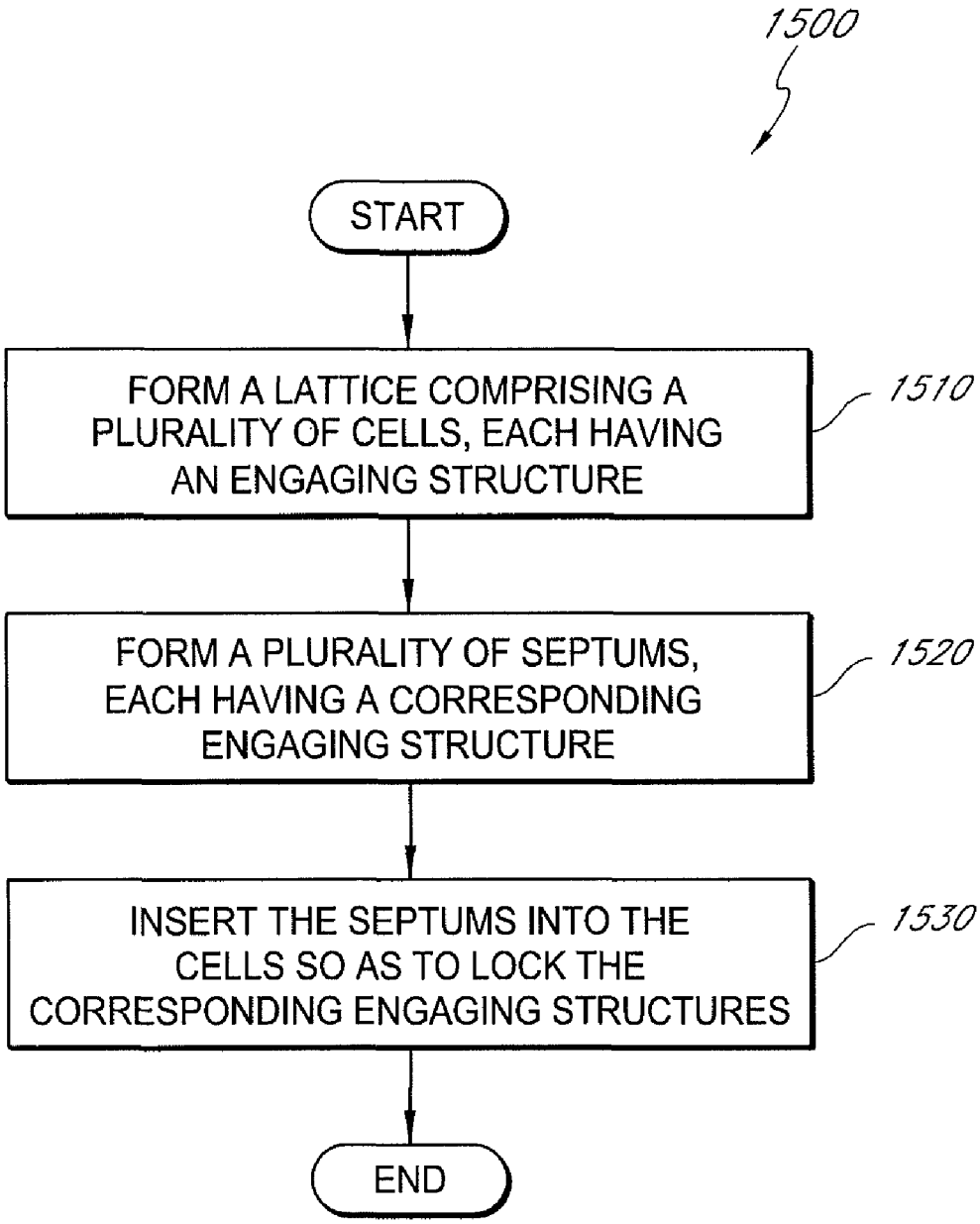
FIG. 15 is a flowchart illustrating a method of manufacturing an acoustic structure according to a preferred method of the invention.

FIG. 15 is a flowchart illustrating a method of manufacturing an acoustic structure 1500 according to a preferred embodiment of the present invention. The method begins, in block 1510, with the formation of a core. The core comprises a plurality of cells, each having an engaging structure. The core can be formed of any suitable material as described above with respect to the core 214 of FIG. 3. The core can be formed by joining a plurality of core sheets as described above with respect to FIGS. 14A-14B. In one embodiment, forming the core includes perforating or punching portions of the core so as to form engaging structure such as openings, indentations, or protrusions within the core.

Next, in block 1520, septums are formed. The septums can be formed of any suitable material as described above with respect to the septums 330 of FIG. 3. In one embodiment, the septum is punched from a sheet of woven cloth material. In one embodiment, forming the septums includes forming each septum with a corresponding engaging structure which engages the engaging structure of the core. For example, the septums can include tabs, prongs, or protrusions.

Figure 16A:
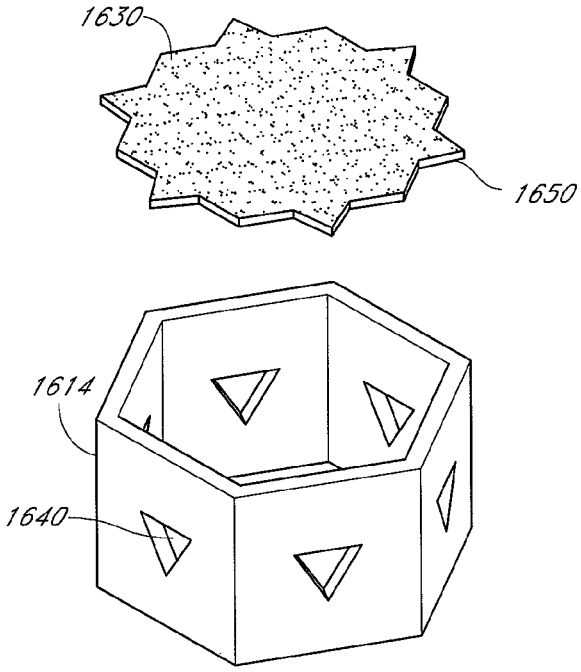
FIG. 16A is a perspective view of an assembly process in which the septum is first located above a singe cell.
Figure 16B:
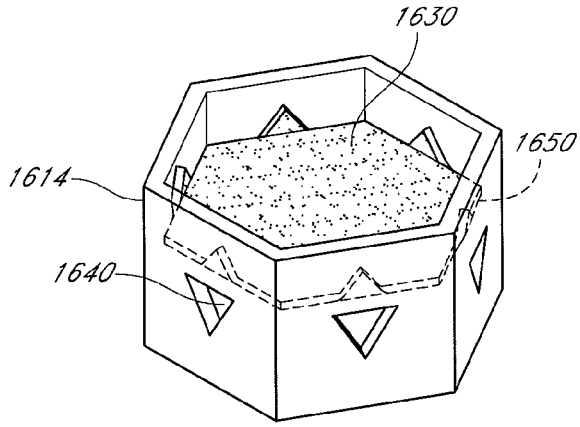
FIG. 16B is a perspective view of the cell and septum of FIG. 16A after the septum has been partially inserted into the cell but prior to locking the septum in the cell.
Figure 16C:
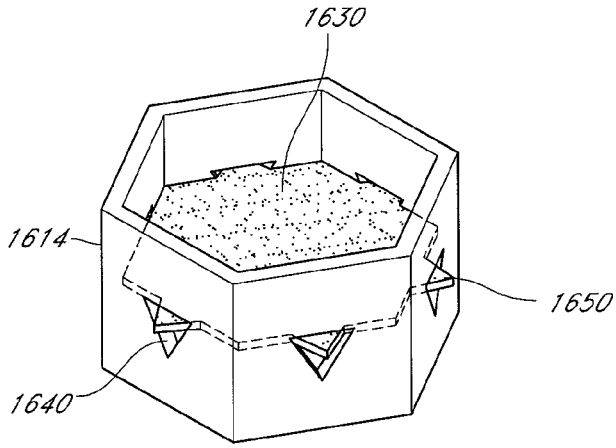
FIG. 16C is a perspective view of the cell and septum of FIG. 16C with the septum fully inserted and locked in the cell.

The method continues in block 1530 where the septums are inserted into the cells. Alternatively, the core is formed around the septums. In one embodiment, when the septum is inserted, engaging structure of the septum engages or locks with corresponding structure of the core. For example, in one embodiment, when a septum is inserted, tabs project through slots formed in the core. In another embodiment, when a septum is inserted, it is supported by protrusions formed in the core. FIGS. 16A-16C, described in detail below, illustrate such an insertion.

Although the steps associated with blocks 1510, 1520, and 1530 are described sequentially, it is to be appreciated that they could be formed in any order, simultaneously, or overlapping in time. For example, in one embodiment, forming the septum (in block 1520) and inserting the septum (in block 1530) are performed simultaneously. Thus, in one embodiment, the septum is punched from a sheet and inserted into the cell in a single motion of a punch.

In one embodiment, an adhesive sealant is applied around the inner perimeter of the cell, affixing the septum within the cell and sealing an inner cell apart form an outer cell, except via the septum which may be porous, as described above with respect to FIG. 3.

In one embodiment, the septum includes protrusions which bend when the septum is inserted into a cell of the core such that the septum is within a channel defined by the cell walls. Further, once in position, the protrusions regain their original shape and project beyond the channel. This process is now described with respect to FIGS. 16A-16C.

FIG. 16A is a perspective view of a cell of a core 1614 and a separate septum 1630. The core 1614 includes engaging structure in the shape of triangular-shaped openings 1640. The septum 1630 includes a number of corresponding triangular-shaped tabs 1650. When the septum 1630 is partially inserted into the cell, the tabs 1650 bend upwards and elastically deform as shown in FIG. 16B. When the septum 1630 is inserted further into the cell, each tab 1650 pops through its corresponding opening 1640 regaining enough of its original shape to effectively engage with the opening 1640 as shown in FIG. 16C.

The shape of the triangular opening 1640, in conjunction with the hysteresis causing the tabs 1650 to regain their original shape, biases the septum 1630 upwards. This biasing of the septum 1630 reduces any gap that is formed around the perimeter of the septum 1630 in the region of the opening 1640 and on the upper side of the cell. The upper side, as opposed to the bottom side, is often subsequently sealed with adhesive to provide the Helmholtz effect. By biasing the septum, the need for additional adhesive or sealant material in this region may be diminished improving the overall efficiency of the manufacturing process.

Although FIGS. 16A-16C illustrate insertion of the septum 1630 from the top side of the core 1614, it is to be appreciated that the septum 1630 could be inserted from either the top or bottom side of the core 1614. It should be appreciated that other slot shapes and tab shapes can be used, as discussed above.

The various embodiments of acoustic structures and noise reduction techniques described above thus provide a number of ways to reduce engine noise. In addition, the techniques described may be broadly applied for use in a variety of noise reduction procedures.

Of course, it is to be understood that not necessarily all such objectives or advantages may be achieved in accordance with any particular embodiment using the systems described herein. Thus, for example, those skilled in the art will recognize that the systems may be developed in a manner that achieves or optimizes one advantage or group of advantages as taught herein without necessarily achieving other objectives or advantages as may be taught or suggested herein. For example, the triangular openings 1640 of FIGS. 16A-16C can be used in the core 514 of FIGS. 5A-5D. As another example, the two-material septum 730 of FIGS. 7A-7B can be used in the acoustic structure 410 of FIG. 4.

Furthermore, the skilled artisan will recognize the interchangeability of various features from different embodiments. Although these techniques and systems have been disclosed in the context of certain embodiments and examples, it will be understood by those skilled in the art that these techniques and systems may be extended beyond the specifically disclosed embodiments to other embodiments and/or uses and obvious modifications and equivalents thereof. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the systems disclosed herein disclosed should not be limited by the particular disclosed embodiments described above.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by any presented claims rather than by the foregoing description. All variations coming within the meaning and range of equivalency of presented claims are embraced within their scope.

What is claimed is:

1. An acoustic structure comprising: a core comprising a plurality of cells, wherein each of the plurality of cells is defined by walls, at least one of the walls having an opening, the opening having a closed perimeter disposed entirely in the wall for positioning a septum relative to the cell; and a plurality of septums positioned relative to the plurality of cells.

2. The acoustic structure of claim 1, wherein a cross-section of the core comprises a plurality of hexagons.

3. The acoustic structure of claim 1, wherein the opening has a circular shape.

4. The acoustic structure of claim 1, wherein the opening has a rectangular shape.

5. The acoustic structure of claim 1, wherein the opening has a triangular shape.

6. The acoustic structure of claim 1, wherein each cell comprises a surface engaged with a surface of the septum.

7. The acoustic structure of claim 1 further comprising sealant disposed around an inner perimeter of at least one of the plurality of cells.

8. The acoustic structure of claim 1 further comprising a solid outer layer and a perforated inner layer, wherein the core is disposed between the inner layer and the outer layer.

9. The acoustic structure of claim 1, wherein the opening is sized and shaped so as to bias the plurality of septums in a direction.

10. The acoustic structure of claim 1, wherein each of the plurality of septums comprises one or more engaging structures for interacting with the opening.

11. The acoustic structure of claim 10, wherein the opening contacts at least one of the engaging structures of the septums.

12. The acoustic structure of claim 10, wherein the one or more engaging structures of the septums include a protrusion.

13. The acoustic structure of claim 10, wherein the one or more engaging structures of the septums include a tang.

14. The acoustic structure of claim 10, wherein the one or more engaging structures of the septums extend through the cell.

15. The acoustic structure of claim 10, wherein the one or more engaging structures of the septums extend through the cell and into an adjacent cell of the plurality of cells.

16. The acoustic structure of claim 1, wherein the engaging structures of the septums are protrusions, at least a portion of one of the protrusions extending into at least a portion of the opening.

17. The acoustic structure of claim 16, wherein the portion of the protrusion extends through the cells.

18. The acoustic structure of claim 16, wherein the portion of the protrusion extends through the opening and into an adjacent cell of the plurality of cells.

19. A method of reducing noise, the method comprising: installing an acoustic structure proximal to a source of noise, the acoustic structure comprising: a core comprising a plurality of cells, wherein each of the plurality of cells is defined by walls, at least one of the walls having an opening, the opening having a closed perimeter disposed entirely in the wall for positioning a septum relative to the cell; and a plurality of septums positioned relative to the plurality of cells.

20. A method of manufacturing an acoustic structure, the method comprising: providing a core comprising a plurality of cells, wherein at least one of the plurality of cells is defined by walls, at least one of the walls having an opening, the opening having a closed perimeter disposed entirely in the wall for positioning a septum relative to the cell; and inserting a septum having at least one engaging structure into the at least one of the plurality of cells, the engaging structure of the septum abutting the opening of the cell so as to hinder movement of the septum relative to the cell in at least one direction.

21. The method according to claim 20, further comprising applying a sealant to the cell and the septum.

22. An acoustic core comprising at least one cell having an inner surface and at least one septum, wherein the inner surface has an opening, the opening having a closed perimeter disposed entirely in the inner surface, and at least a portion of the septum engaging the opening in the inner surface so as to hinder movement of the septum relative to the cell.

23. The core of claim 22, wherein the portion of the septum extends through the inner surface.

24. An acoustic structure comprising: a perforated first sheet; an imperforate second sheet; a core structure comprising a plurality of cells defined by cell walls disposed between the first and second sheets, the cells walls defining an interior perimeter surface for each cell; and a septum disposed within each of the cells, each septum having an outer perimeter surface adjacent to the interior perimeter surface of the cell it is disposed within, at least one of the cell walls including at least one opening having a closed perimeter disposed entirely in the wall and a portion of the septum disposed within the cell extends through the opening.

25. The acoustic structure of claim 1 further comprising a perforated first sheet affixed to one end of the core and an imperforated second sheet affixed to the other end of the core.

26. The core of claim 22 further comprising a perforated first sheet affixed to one end of the core and an imperforated second sheet affixed to the other end of the core.

* * * * *